US012371921B1

(12) United States Patent
Dorn

(10) Patent No.: US 12,371,921 B1
(45) Date of Patent: Jul. 29, 2025

(54) INTERCHANGEABLE POLE SUPPORT AND DEVICE ATTACHMENT SYSTEM

(71) Applicant: Mark Dorn, Knoxville, TN (US)

(72) Inventor: Mark Dorn, Knoxville, TN (US)

( * ) Notice: Subject to any disclaimer, the term of this patent is extended or adjusted under 35 U.S.C. 154(b) by 10 days.

(21) Appl. No.: 18/487,651

(22) Filed: Oct. 16, 2023

Related U.S. Application Data

(60) Provisional application No. 63/416,192, filed on Oct. 14, 2022.

(51) Int. Cl.
*E04H 12/22* (2006.01)
*E04H 12/18* (2006.01)

(52) U.S. Cl.
CPC ..... *E04H 12/2238* (2013.01); *E04H 12/182* (2013.01); *E04H 12/2253* (2013.01)

(58) Field of Classification Search
CPC ..... E04H 12/2238; E04H 12/182; E04H 12/2253
See application file for complete search history.

(56) References Cited

U.S. PATENT DOCUMENTS 4,500,064 A * 2/1985 Calabro ..... E04H 12/22 248/539
4,657,112 A * 4/1987 Ream ..... B66F 11/04 52/118
9,446,932 B2 * 9/2016 Nobles ..... E04H 12/347
2015/0023017 A1 * 1/2015 Smith ..... F21L 13/00 362/249.03

* cited by examiner

*Primary Examiner* — Anita M King
(74) *Attorney, Agent, or Firm* — Pitts Lake, LLC

(57) ABSTRACT

A mast elevation system including support mounts configured to be removably attachable and interchangeable to various mounting members, a telescopic mast unit having quick-change attachment components configured to removably and interchangeably secure the telescopic mast unit to the various support mounts, the telescopic mast unit having a second end with a receptacle thereon to removably and interchangeably receive various utility devices, and an actuation unit configured to raise and lower the telescopic mast unit.

10 Claims, 13 Drawing Sheets

INTERCHANGEABLE POLE SUPPORT AND DEVICE ATTACHMENT SYSTEM

CROSS-REFERENCE TO RELATED APPLICATION

This application claims the benefit of U.S. Provisional Application No. 63/416,192 filed on Oct. 14, 2022, the disclosure of which is incorporated by reference herein in its entirety.

BACKGROUND

It is known to provide systems containing articulating mast mounts for use on sloping terrain. For example, U.S. Pat. No. 7,959,911 provides an articulating mast mount including a built-in platform for quick and easy camera access and wheels which make it easy to move the device to and from a vehicle. Such known devices include features such as lateral articulation for two-dimensional mast leveling, and fold out stabilizer legs enabling the device to operate without the need of a vehicle. U.S. Pat. No. 8,152,114 provided additional features relating to electronic connectivity of such systems such as wired and wireless data/video transmission, internet connection, and remote control.

It is known to provide systems containing articulating mast mounts for use on sloping terrain. For example, U.S. Pat. No. 7,959,911 provides an articulating mast mount including a built-in platform for quick and easy camera access and wheels which make it easy to move the device to and from a vehicle. Such known devices include features such as lateral articulation for two-dimensional mast leveling, and fold out stabilizer legs enabling the device to operate without the need of a vehicle. U.S. Pat. No. 8,152,114 provided additional features relating to electronic connectivity of such systems such as wired and wireless data/video transmission, internet connection, and remote control.

While known pole systems can be used to elevate devices and support a variety of equipment, ranging from communication applications to lighting, the poles of such systems are typically tied to a single support or mount, limiting portability of the system and thus limiting the flexibility of deployments. Moreover, known systems are less than satisfactory in accommodating interchangeability of a variety of attachments to a single mast elevation system.

BRIEF SUMMARY

Example embodiments of the present general inventive concept can be achieved by providing systems and methods configured to provide a mast elevation system including support mounts configured to be removably attachable and interchangeable to various mounting members, or surfaces, including a telescopic mast unit having quick-change attachment means, or structures, to removably and interchangeably secure the telescopic mast unit to the various support mounts, the telescopic mast unit having an extendable end, or tip, formed with a receptacle thereon to removably and interchangeably receive various utility devices. An actuation unit can be configured to raise and lower the telescopic mast unit as known in the art.

Additional features and embodiments of the present general inventive concept will be apparent to those of ordinary skill in the art upon review of the present disclosure.

BRIEF DESCRIPTION OF THE FIGURES

The following example embodiments are representative of example techniques and structures designed to carry out the objects of the present general inventive concept, but the present general inventive concept is not limited to these example embodiments. In the accompanying figures, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying figures in which.

DETAILED DESCRIPTION

Figure 1:
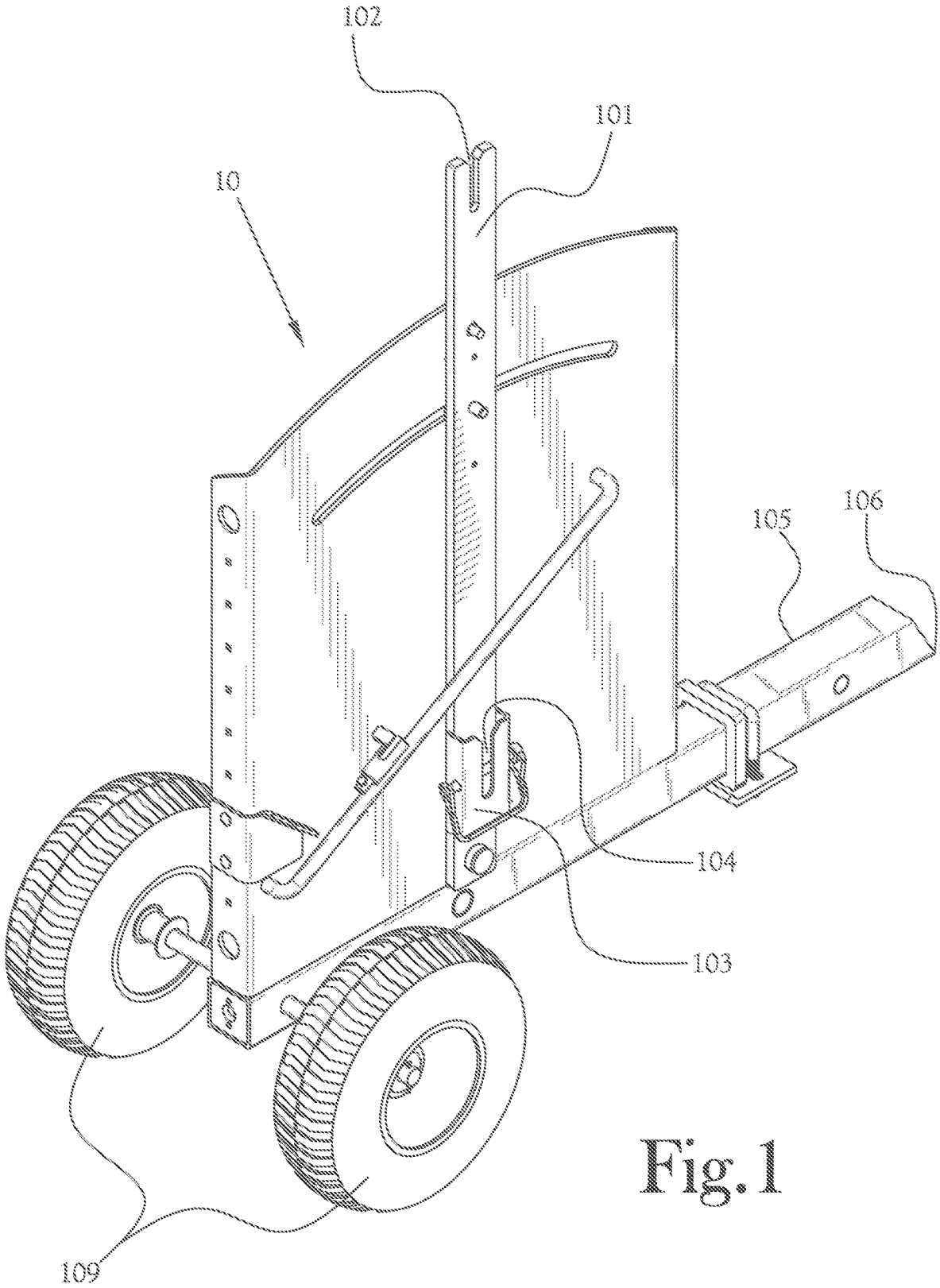
FIG. 1 illustrates a right side perspective view of a hitch receiver support mount according to an example embodiment of the present general inventive concept.
Figure 2:
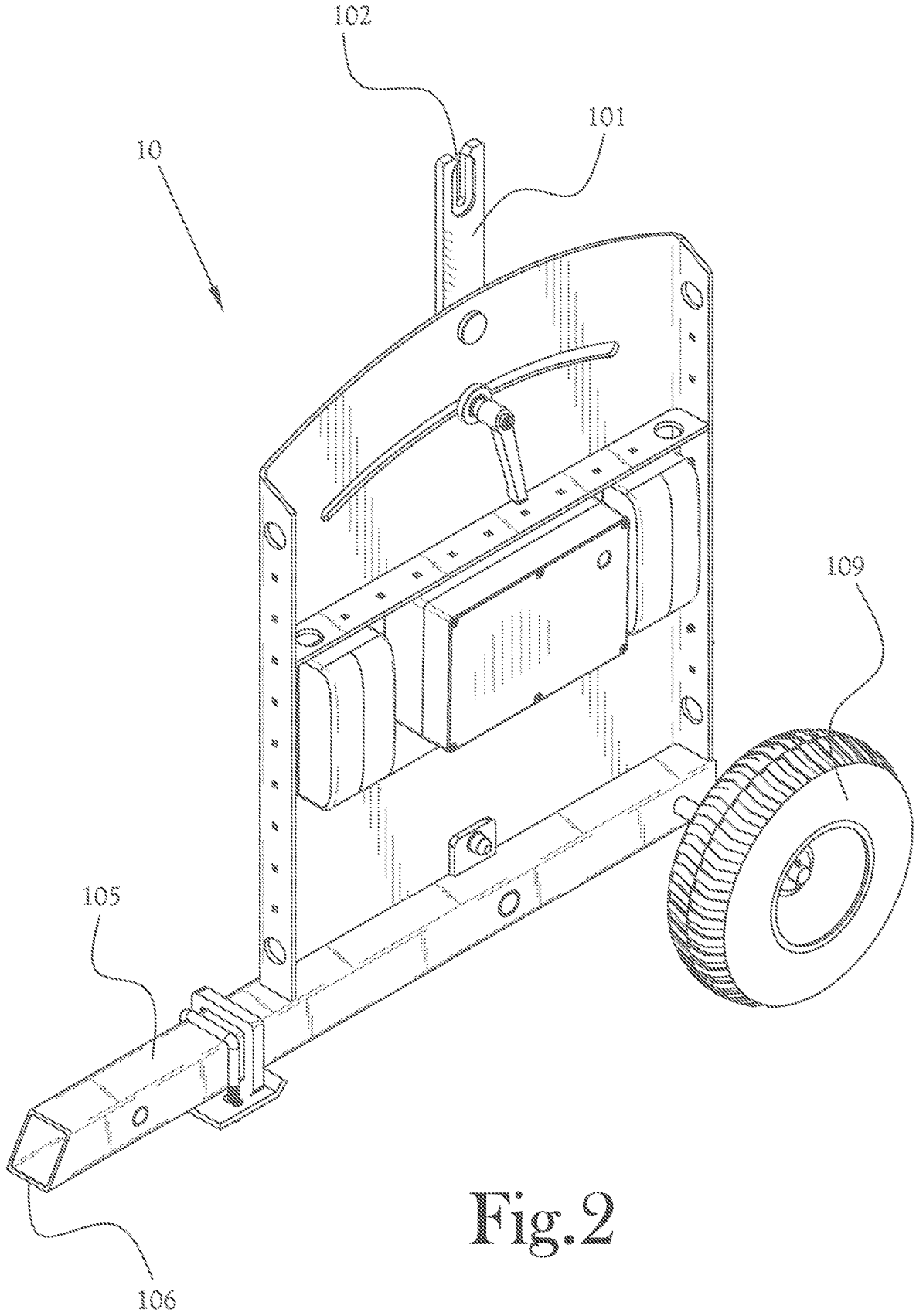
FIG. 2 illustrates a left side perspective view of the hitch receiver support mount of FIG. 1.

Example embodiments of the present general inventive concept are described more fully hereinafter with reference to the accompanying drawings, which form a part hereof, and which show, by way of illustration, exemplary embodiments by which the invention may be practiced. The invention may, however, be embodied in many different forms and should not be construed as limited to the embodiments set forth herein; rather, these embodiments are provided so that this disclosure will satisfy the statutory requirements and convey the scope of the invention to those skilled in the art.

Accordingly, embodiments are not limited to the embodiments described herein or depicted in the drawings, and various embodiments and modifications can be made without departing from the scope of the claims presented.

As illustrated in the accompanying figures, example embodiments of the present general inventive concept provide a telescopic pole/mast system that can be easily connected/disconnected to various quick-change support members, such as the hitch receiver of a pick-up truck or other vehicle. Additional accessory quick-change support members, such as a tripod mounting member, wall mounts, wheel mounts, etc. can be configured to be portable, for example carried within the bed of the pick-up truck or other cargo space for quick deployment. The support members can be configured to quickly receive the telescopic mast unit in order to elevate a variety of attachments or utility devices depending on the application, such as, but not limited to, surveillance cameras, antennas, loudspeakers, lighting equipment, sensing/detection devices, or other devices.

If a situation develops where it is desired to keep the mast elevation system in a particular area, but the truck needs to leave the area, one or more of the accessory support members can be deployed, enabling a user to quickly remove the mast system from the hitch receiver and install it to an accessory support member, such as a tripod, wall mount, wheel mount, etc., enabling the truck or other mobile asset to leave the area but maintaining and supporting the telescoping mast unit in the particular area for surveillance or other purposes.

In some embodiments, a tripod unit can be deployed to support the mast unit. Here, the tripod legs can be quickly unfolded on the ground, and the mast unit can be quickly disconnected from the hitch receiver of the truck or other support member, and re-connected to the tripod legs, eliminating the need to provide multiple masts should the truck need to leave the area or to move the mast member from one support to another. As such, a user can utilize a single telescoping pole/mast unit interchangeably with the tripod of other supports/mounts, thus providing deployment flexibility without the need to purchase multiple poles/masts and without requiring the truck or vehicle to stay in the area to support the mast.

During transport of the mast system to an area of interest, embodiments of the present general inventive concept can be configured to provide a mast elevation system that can be quickly removed from a support member, such as the hitch receiver of a vehicle, allowing the mast member to be stored horizontally in the vehicle, providing clearance for the vehicle to enter low clearance areas, such as parking garages, tunnels, overpasses, etc. This is beneficial when the vehicle is entering a covered area with insufficient clearance, because when the mast unit is connected to the hitch receiver of a motor vehicle during transport, the mast member may extend vertically above the ground approximately 10 feet, making it impossible for the vehicle to enter a low clearance area without damaging the mast unit. Quick removability and storage of the mast unit can therefore be achieved.

Example embodiments of the present general inventive concept can also be configured to be compatible with a variety of available mounts system-wide, and can be quickly removed and re-mounted on a variety of supports in seconds, thus greatly reducing the maintenance time and effort involved in deploying poles on various supports.

Unlike existing systems, embodiments of the present general inventive concept are shown to provide a variety of support members, such as wall-mounts allowing the pole to be deployed on any type of vertical solid surface such as a trailer or building wall. Known pole mounts are typically affixed or fastened with screws/bolts to the pole support or mount which means tools are required. Thus, a user cannot easily remove an existing mast from a mount since the mast is securely affixed to the mount with screws. Moreover, the cost to transport the known systems is high, especially if the end user wishes to have the systems pre-assembled.

As illustrated and described herein, example embodiments of the present general inventive concept solve the foregoing problems by providing a lightweight, interchangeable pole support system capable of being quickly "swapped" from one mount to another without the use of tools to support a wide range of attachments or devices, thus providing a portable pole support system that can adapt to uneven terrain to provide a level support for a variety of items. Embodiments also provide the ability to quickly swap any number of utility devices to the tip of the mast unit.

As illustrated in FIGS. 1-8, an example embodiment of a mast/pole elevation system of the present general inventive concept includes a hitch receiver support mount 10 having a mounting means, such as structure 105, configured to horizontally mate with an inner space of a receiver hitch 502 of a vehicle (such as a truck), the mounting structure can include an angular surface 106 extending from a first working end of the mounting means such that when the mounting structure is being removed from the inner space of the receiver hitch 502 (see, e.g, FIG. 5), the mounting structure can be configured to slidably move horizontally within the inner space of the receiver hitch until the angular surface 106 reaches the exposed receiving end of the receiver hitch 502. In this way, the vertex portion 106 of the angular surface can be configured to remain in contact with a bottom portion of the inner space such that the mounting structure 105 is permitted to pivot downward 501 with respect to horizontal while the vertex portion remains in contact with the bottom portion of the inner surface. By remaining in contact with the bottom portion of the inner space when the hitch receiver support mount is being removed (or installed) to/from the receiver hitch, the vertex portion 106 prevents the mounting structure 105 from dropping suddenly as the mounting structure 105 is being installed/removed by the user to/from the receiver hitch. Instead, as the mounting structure 105 is being prepped for installation or removal from the receiver hitch, the vertex portion 106 of the mounting structure enables the mounting structure 105 to rest on the bottom surface as the wheels touch the ground, resulting in downward sloping of the mounting structure toward the wheels 109 of the support mount 10, preventing the entire mounting structure 105 from dropping out of the inner space of the receiver hitch until the wheels 109 are touching the ground, thus preventing a sudden drop of the mounting structure 105 from the receiver hitch 502 during installation or removal.

The pole elevation system can utilize a number of different support mounts. The support mounts illustrated herein can be configured to be removably attachable to various mounting members, including but not limited to a receiver hitch of a vehicle, a tripod mounting device, wheel (e.g., rollover) mount, a building wall, trailers, etc. Any number of different mounting members can be designed to removably accept the telescopic mast unit 505 using sound engineering judgement in view of the present disclosure, and all such mounting members are intended to fall within the scope of the present general inventive concept.

In some embodiments, the telescopic mast unit 505 includes quick-change attachment structures enabling the mast unit 505 to be quickly installed or removed from the various support mounts without the use of tools, thus saving critical time in deployment/re-deployment applications. The quick-change attachment structures can include a ring member 301 disposed on an outer diameter of the telescopic mast unit 505 proximate a first of the telescopic mast unit, the quick-change attachment structure being configured to removably secure the telescopic mast unit to a plate member 101 affixed to a desired support mount. The ring member 301 can be spaced apart from a bottom end of the telescopic mast unit so as to provide elevation support when the mast unit is elevated. The ring member can include a protrusion 302 configured to be mate with a first cut-out portion 102 disposed on an upper end of the plate member 101 of a desired support mount (e.g., 10, 900, 100, 110).

Figure 3:
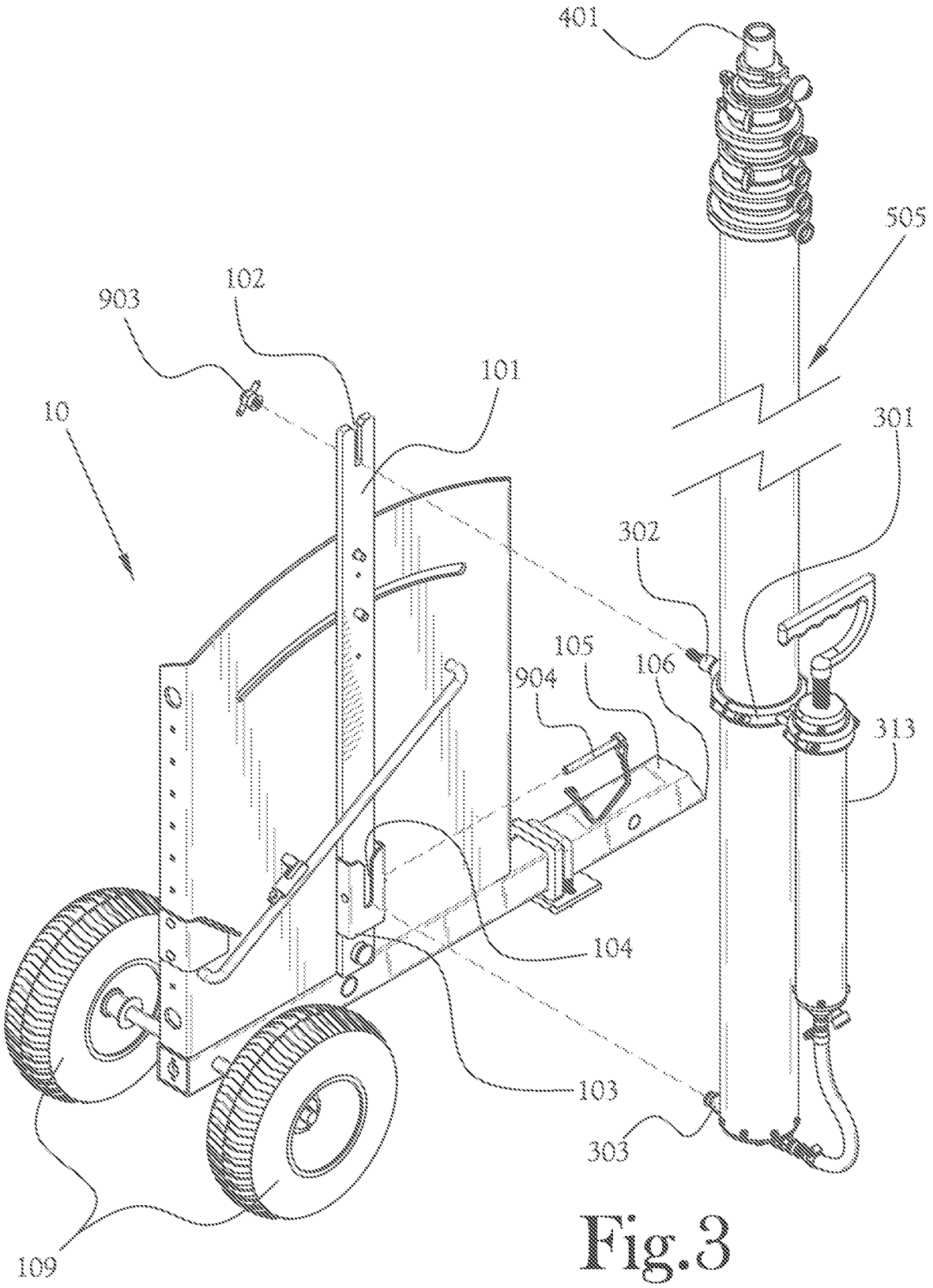
FIG. 3 illustrates an exploded perspective view of the hitch receiver support mount of FIGS. 1 and 2 configured to receive a telescoping mast unit according to an example embodiment of the present general inventive concept.
Figure 4:
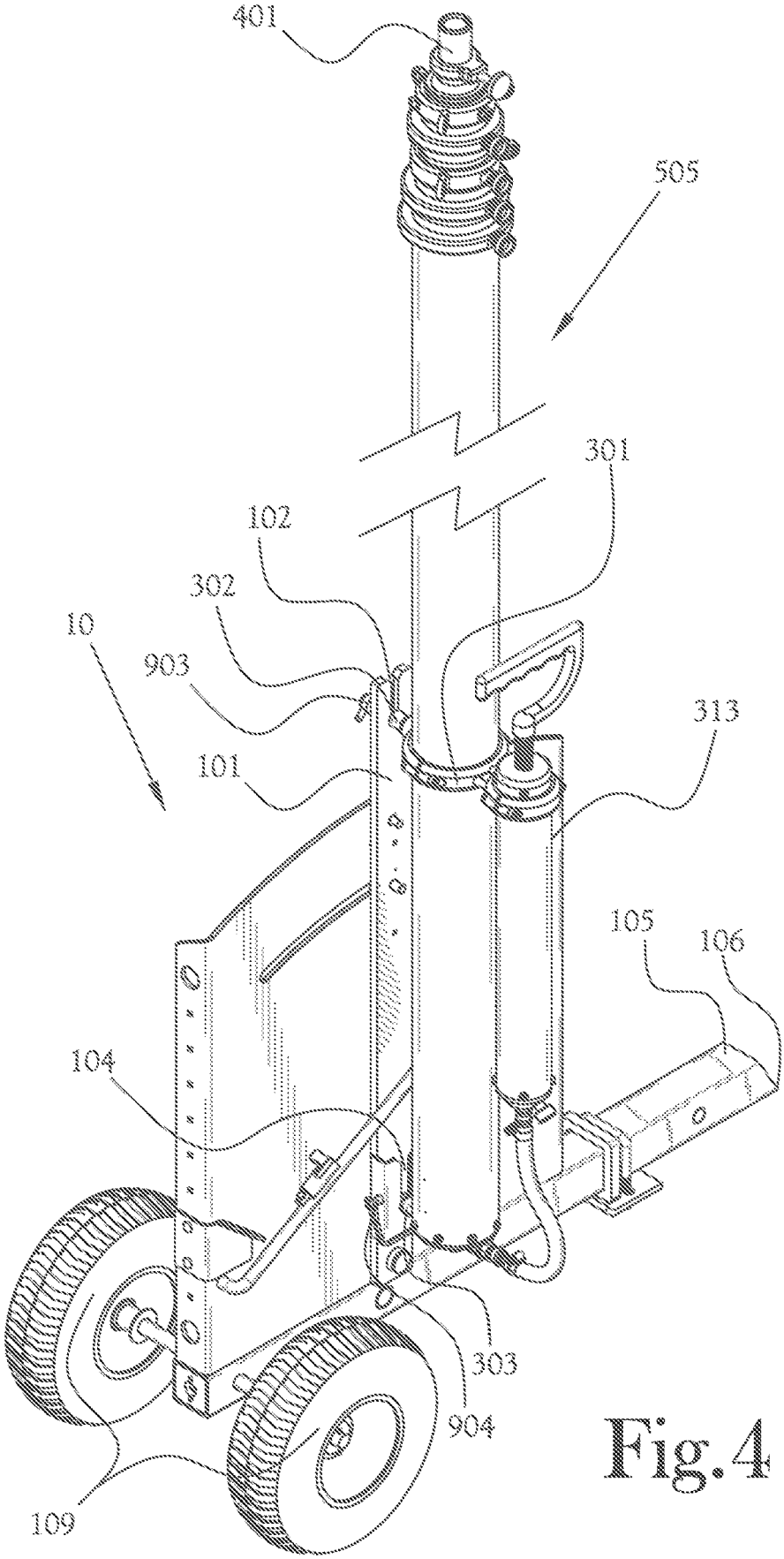
FIG. 4 illustrates a telescoping mast unit installed to a hitch receiver support mount according to an example embodiment of the present general inventive concept.
Figure 5:
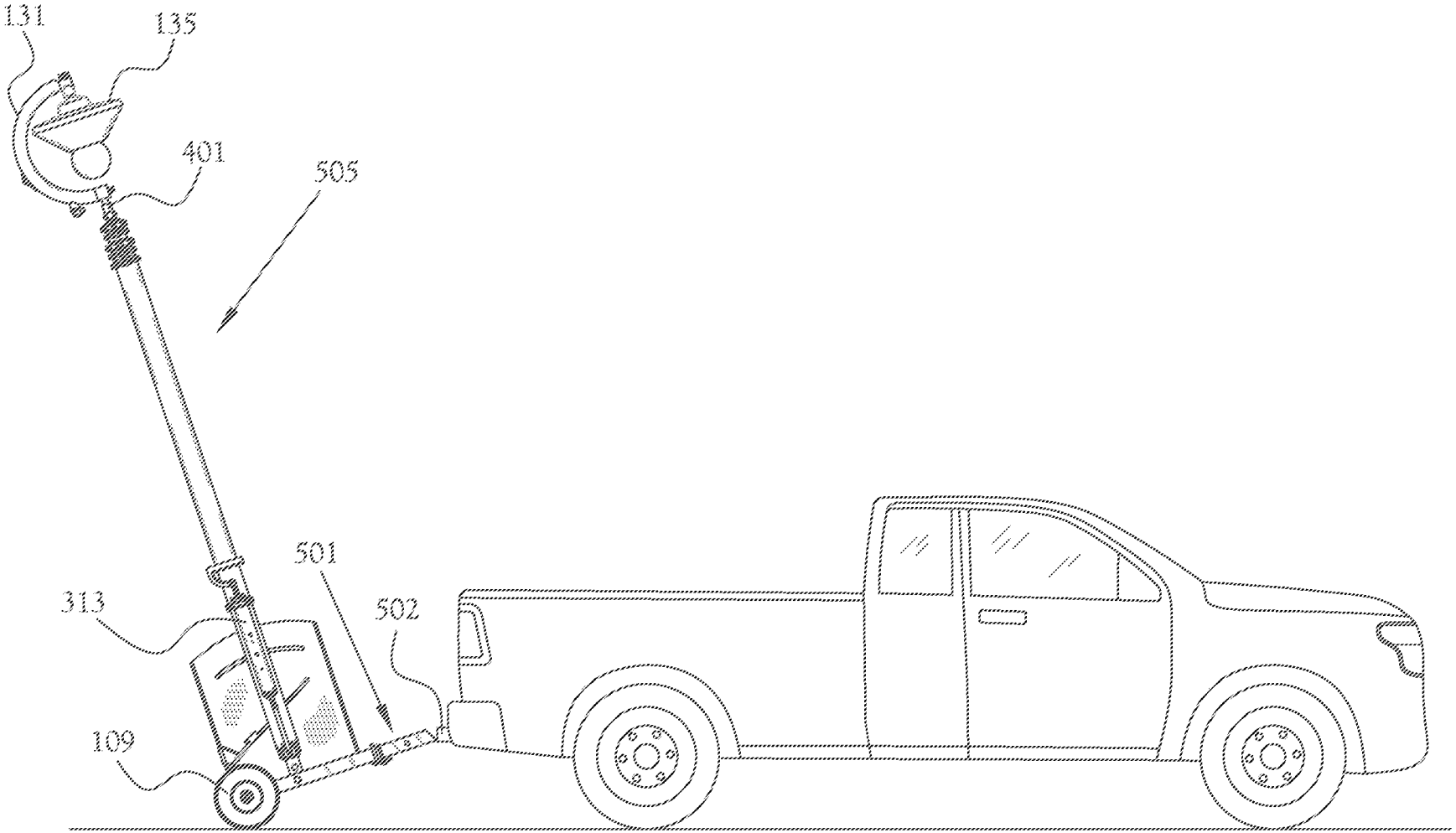
FIG. 5 illustrates a telescoping mast unit installed to a hitch receiver support mount ready for attachment to a hitch receiver of a vehicle according to an example embodiment of the present general inventive concept.
Figure 6:
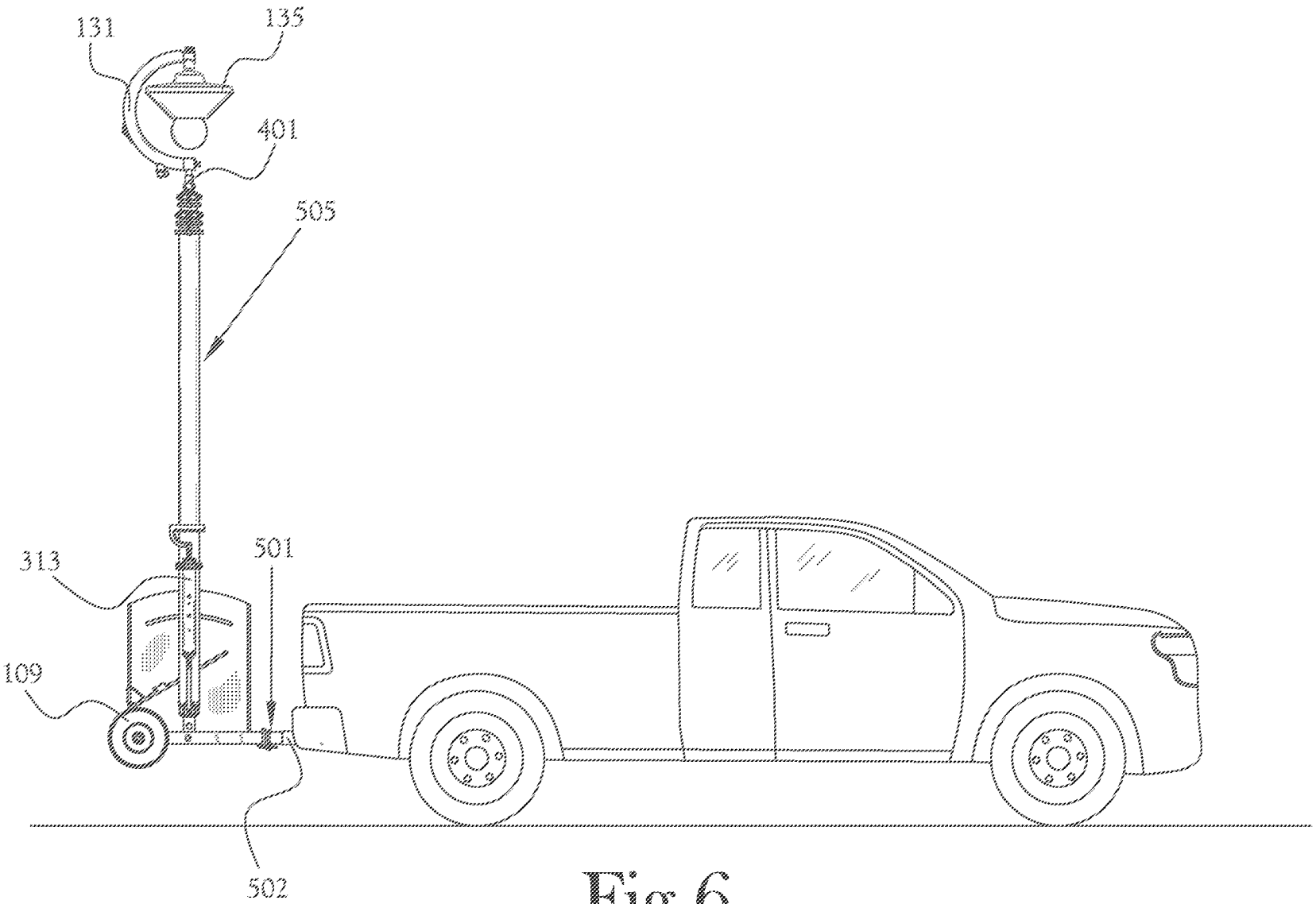
FIG. 6 illustrates a telescoping mast unit installed to a hitch receiver support mount attached to a hitch receiver of a vehicle according to an example embodiment of the present general inventive concept.
Figure 7:
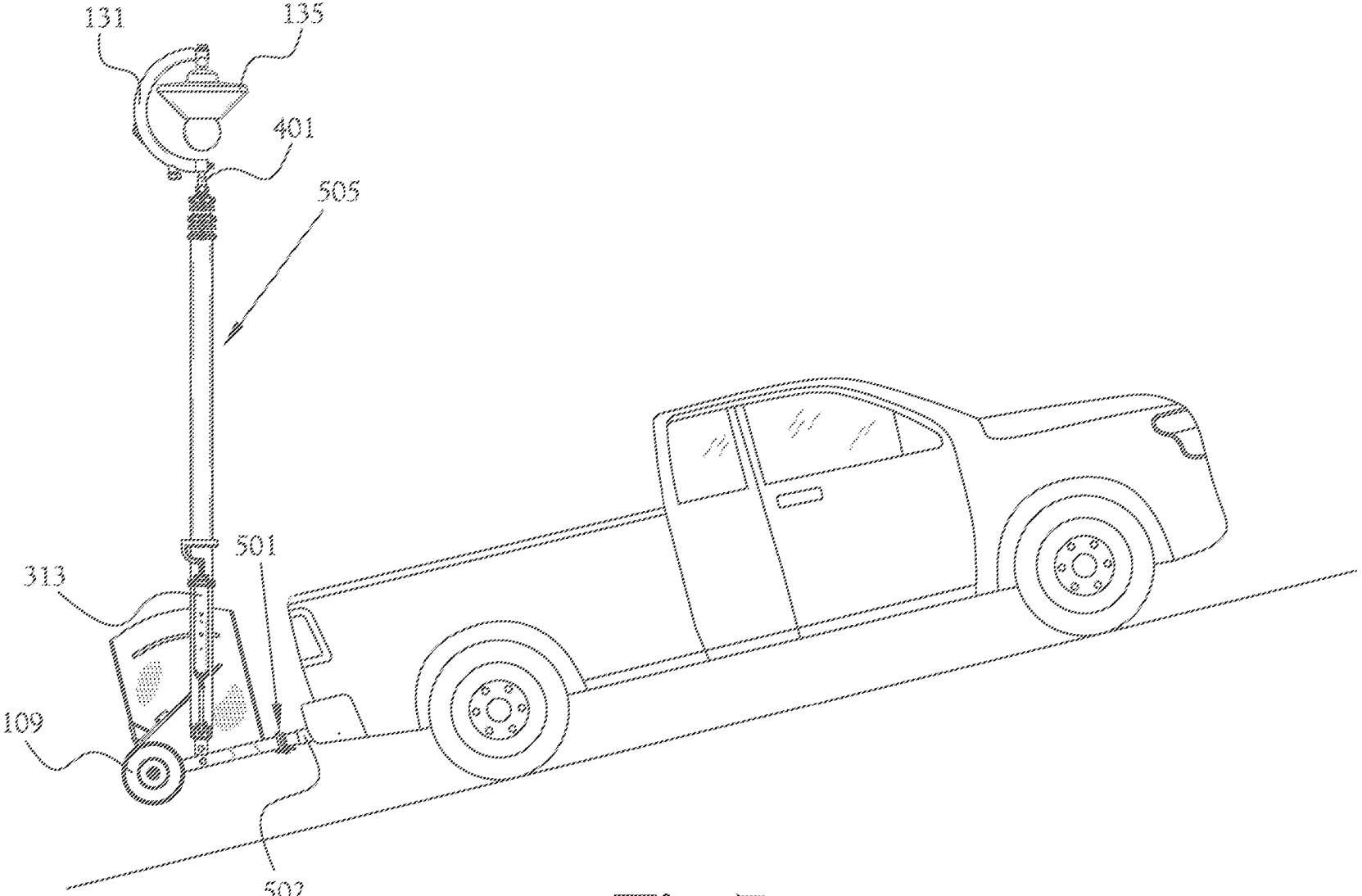
FIG. 7 illustrates the telescoping mast unit assembly of FIG. 6, where the mast unit is pivoted to compensate for uneven terrain according to an example embodiment of the present general inventive concept.

Referring to the various support mounts, the quick-change structures can further include a holster unit 103 on the support mounts, the holster unit being configured to receive a bottom end of the plate member 101, including a second protrusion 303 disposed on the first end of the telescopic mast unit and configured to mate with a second cut-out portion 104 disposed on an upper surface of the holster unit 103. The mating protrusions/cut-outs facilitate quick assembly/change of the telescoping mast unit to/from one or more of the support mounts. Referring mostly to FIGS. 3-4, the quick-change structure can further include securement structures, such as locking devices 903 and 904, to secure the pole mount to the plate member 101 and holster unit 103, respectively, thus preventing the mast unit from inadvertently becoming disconnected to the plate member 101. For example, the locking device 904 can be configured as a pin member configured to retain the protrusion 303 within the holster unit, and the locking device 903 and be configured to lock the protrusion 302 within the cutout portion 102.

Figure 9:
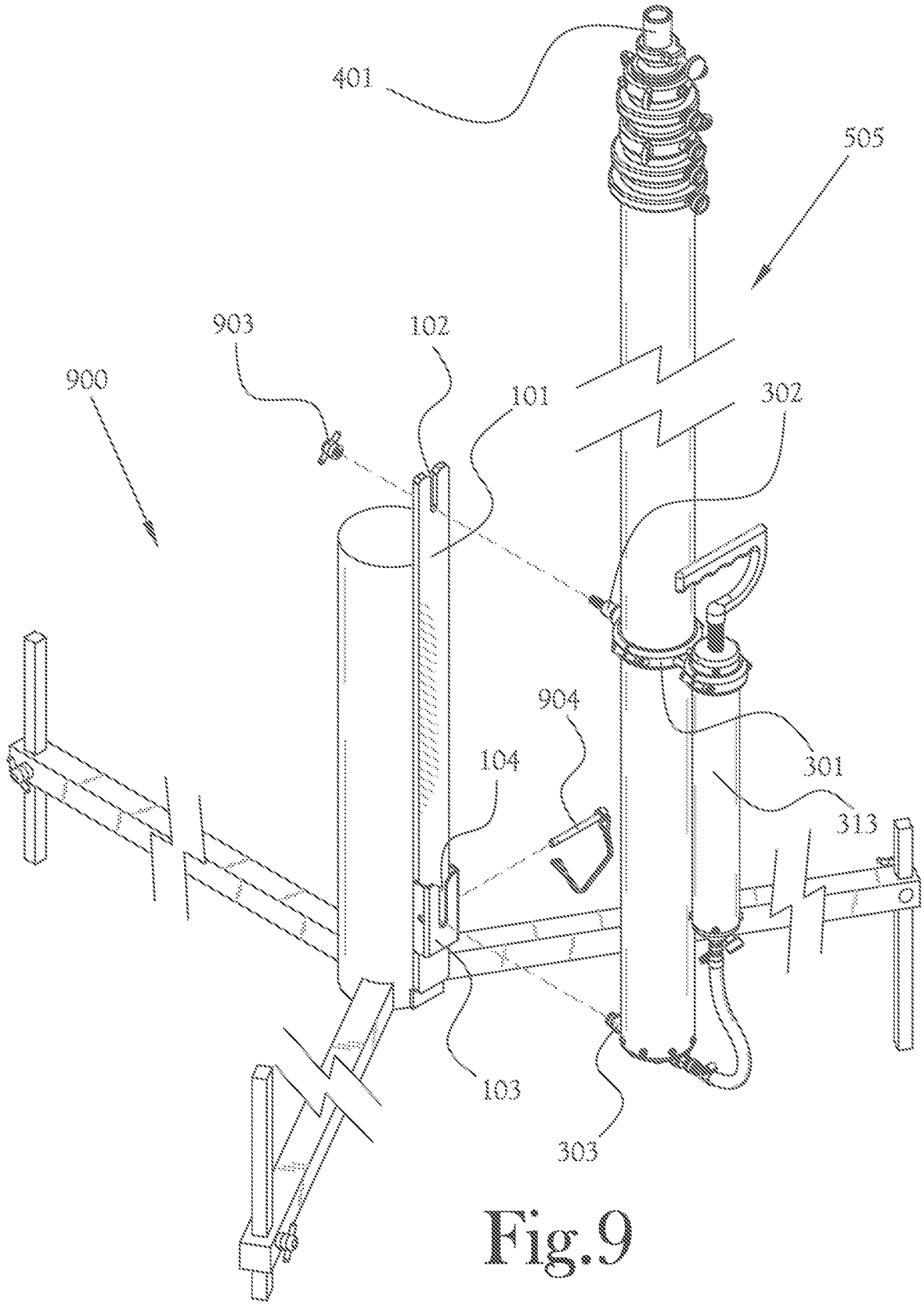
FIG. 9 illustrates a tripod mast support mount configured to receive a telescoping mast unit according to an example embodiment of the present general inventive concept.

As illustrated in FIG. 9, the support mount can be a tripod mast support mount 900 configured to receive a telescoping mast unit 505 utilizing similar quick-change structure.

Figure 10:
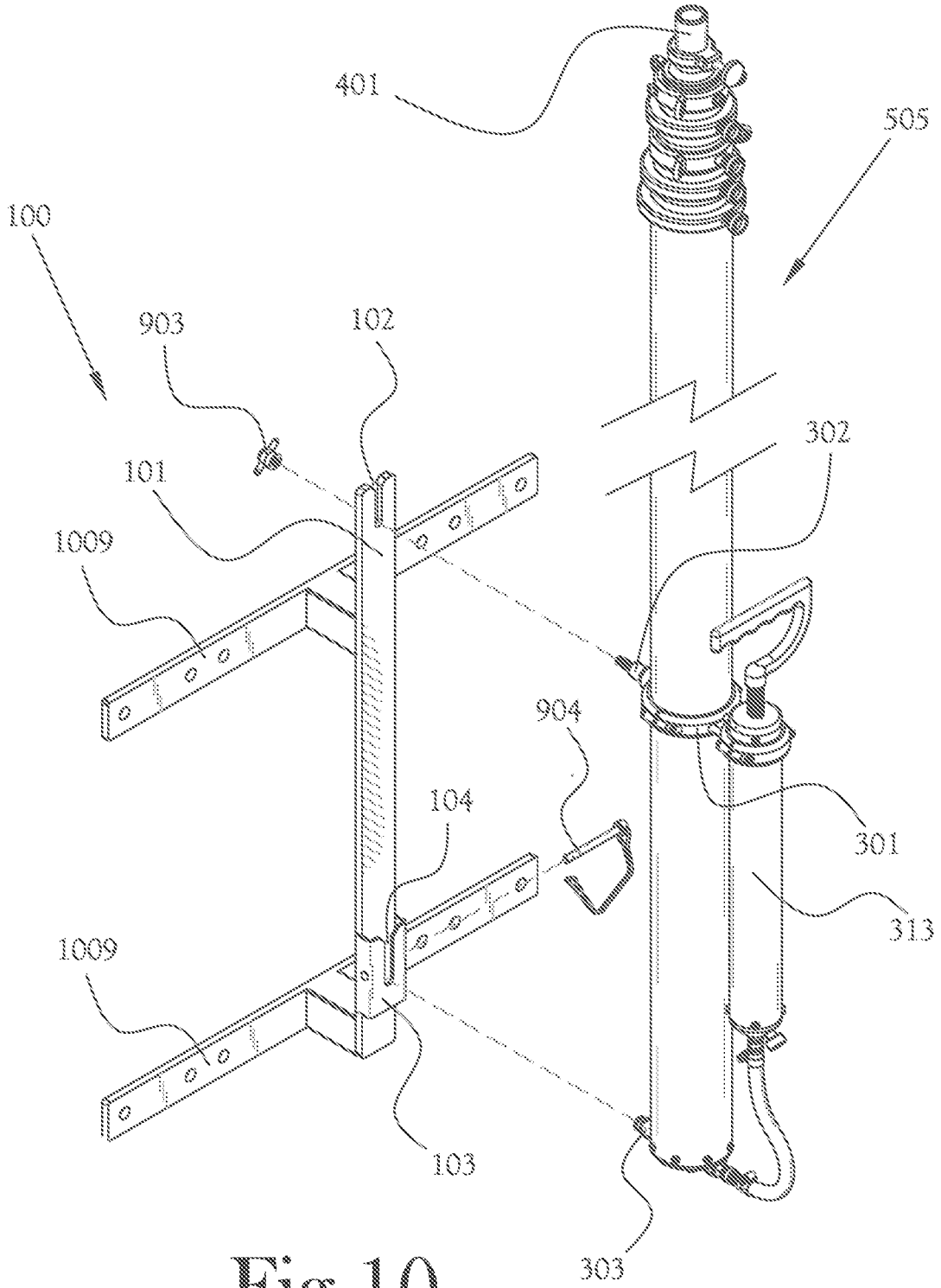
FIG. 10 illustrates a wall support mount unit configured to receive a telescoping mast unit according to an example embodiment of the present general inventive concept.

FIG. 10 illustrates other embodiments including a wall support mount unit configured to receive a telescoping mast unit utilizing similar quick-change structure. Here, the wall support mount can further include wall mounting members 1009 configured to affix the plate member 101 structure to a wall structure of a building, trailer, fence, etc.

Figure 11:
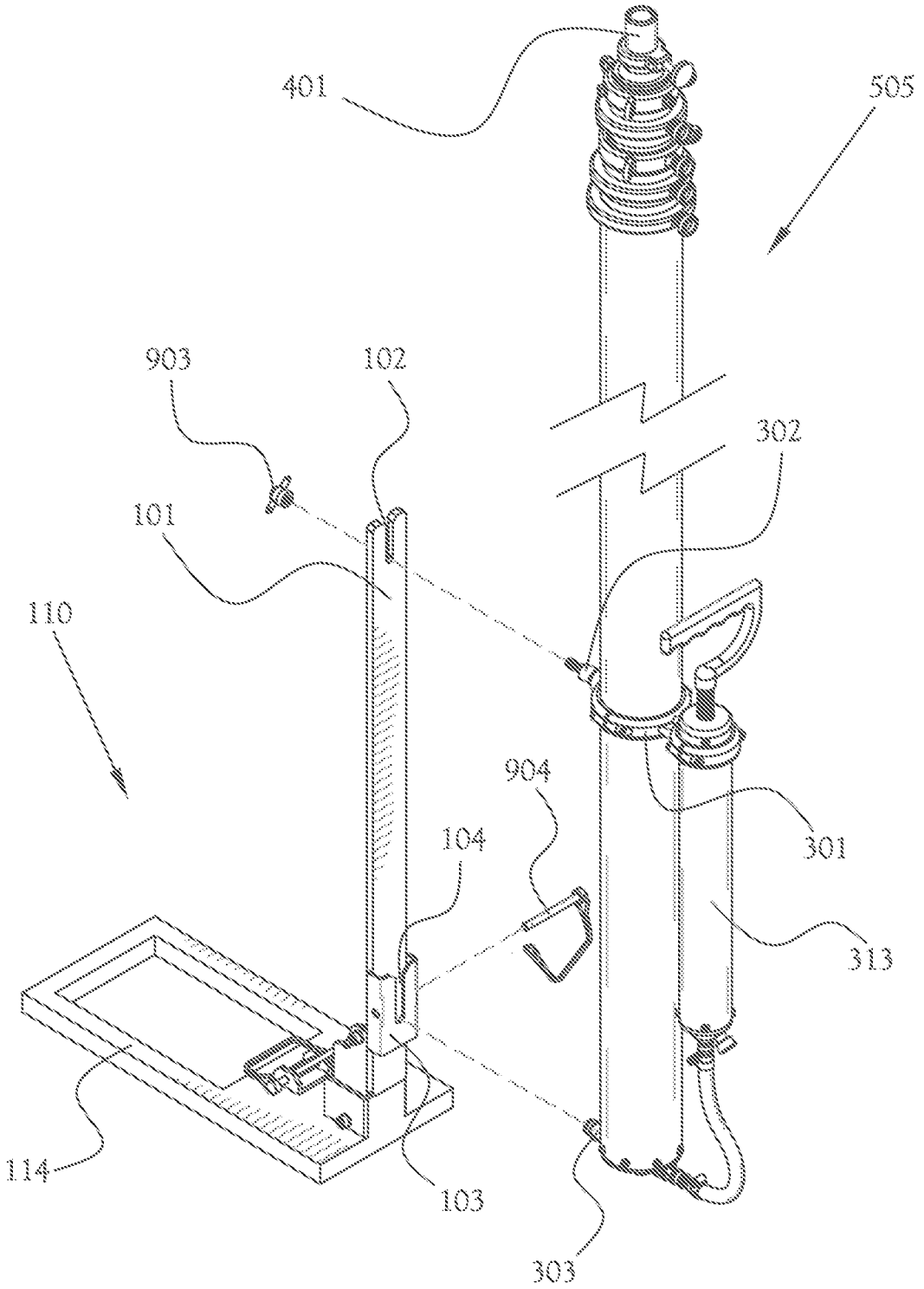
FIG. 11 illustrates a wheel mount unit configured to receive a telescoping mast unit according to an example embodiment of the present general inventive concept.
Figure 12:
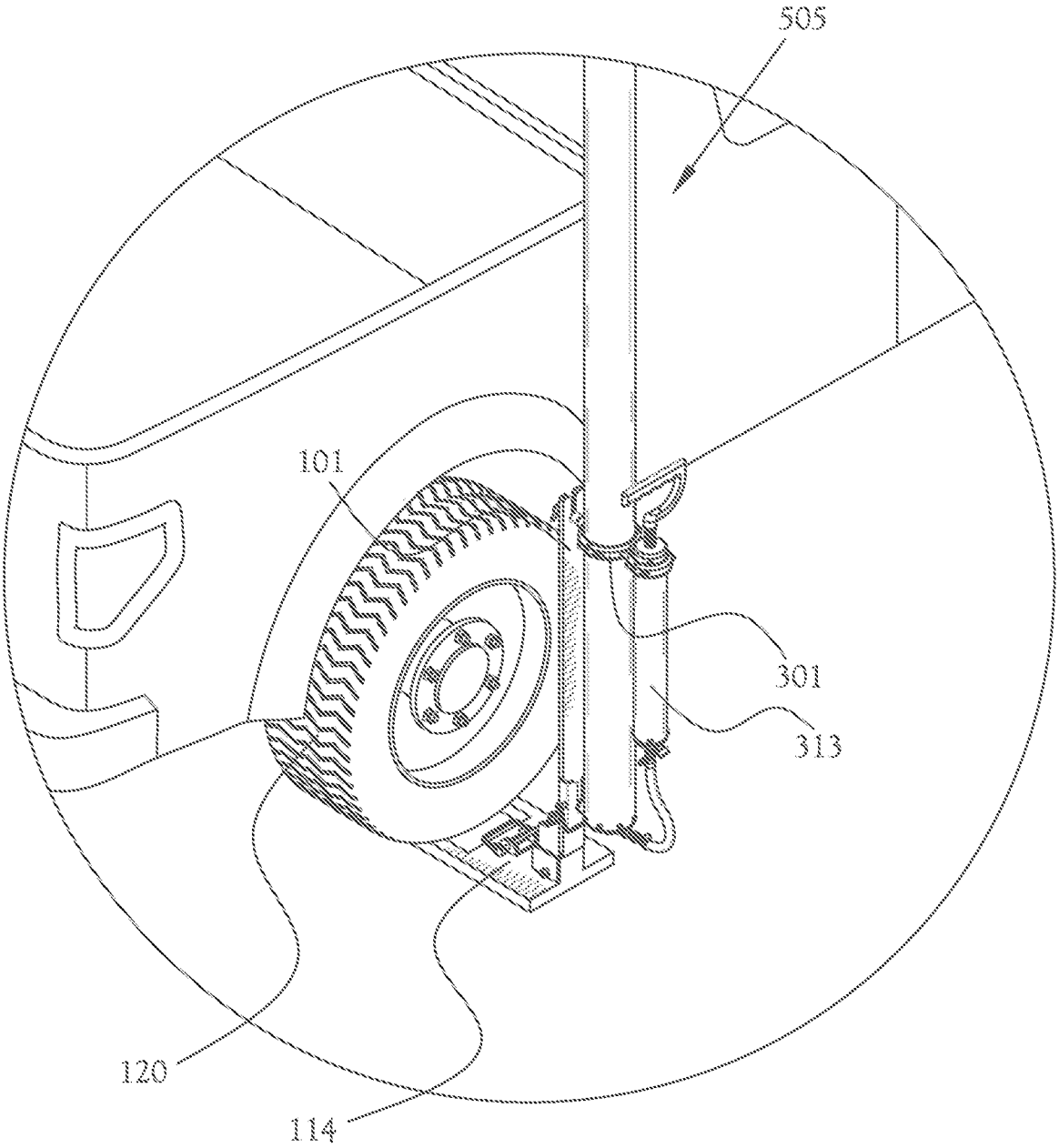
FIG. 12 illustrates the wheel mount unit of FIG. 11 supporting the telescoping mast unit according to an example embodiment of the present general inventive concept.
Figure 13A:
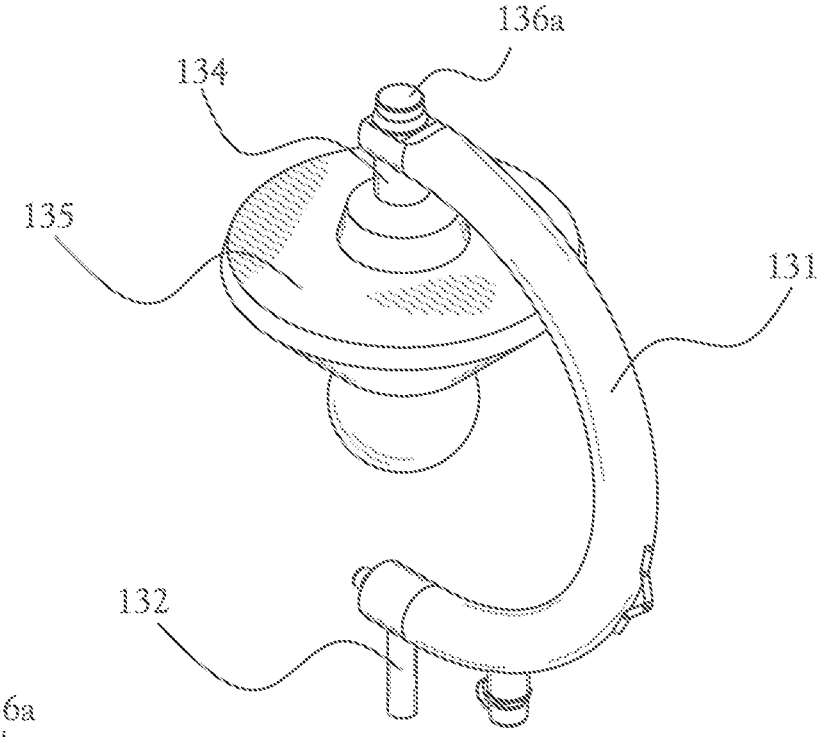
FIGS. 13A to 13C illustrate example device mounts for mounting a variety of utility devices, configured in accordance with example embodiments of the present general inventive concept.
Figure 13B:
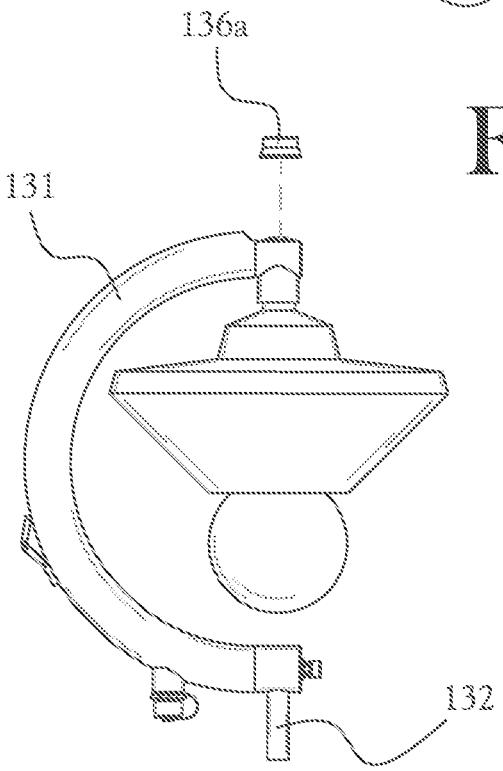
Figure 13C:
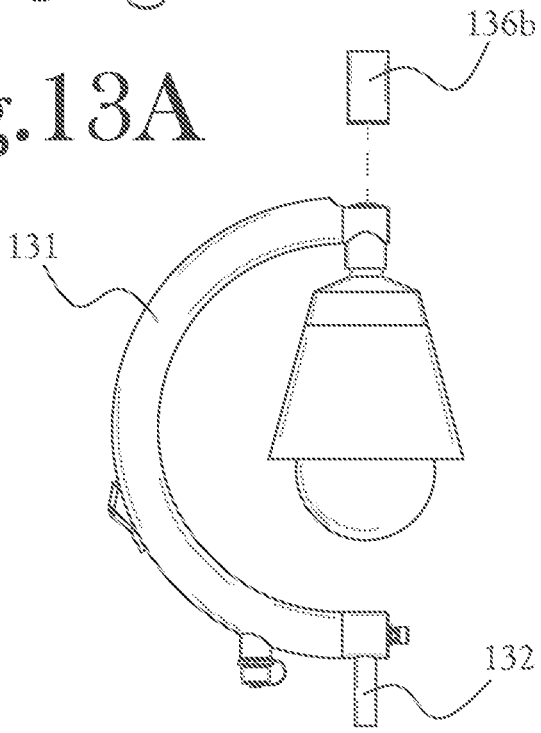

FIGS. 11 and 12 illustrate another example embodiment of the present general inventive concept incorporating a wheel mount unit 110. Here, the mounting member can be configured as a wheel mount structure 110 having a base member 114 configured to receive a vehicle tire 120 over a top surface of the base member 114 so as to secure the base member 114 under the weight of the vehicle tire, thus providing secure support for similar quick-change structure to quickly and securely deploy the mast elevation system by simply driving a vehicle wheel on top of the base member 114. In some embodiments, the plate member 101 can be pivotally attached to an outer end of the wheel mount such that the plate member can pivots between a first position horizontal to the base member (e.g., for storage and/or transport) and second position perpendicular to the base member for deployment.

Referring mostly to FIGS. 8-11 and 13A-13C, the telescopic mast unit 505 can include a receptacle 401 to receive various utility devices, representatively identified as reference number 135. Utility devices can include, but are not limited to, surveillance cameras, antennas, loudspeakers, lighting equipment, sensing/detection devices, etc.

A utility device holding member 131 can be configured to hold a utility device 135 thereon. The receptacle 401 of the mast unit can be configured to matingly receive a first protrusion 132 of the holding member to secure the utility holding member to the upper (i.e., elevated) end, or tip, of the telescopic mast unit. Various accessory devices **136*a*, 136*b* can also be configured to mate with the utility device holding member 131**, such as microphones, antennas, or other communication devices.

In some embodiments, the utility device holding member 131 can be formed in a c-shape such that a top portion of the utility device holding member includes a second protrusion receiver 134 configured to matingly receive the utility device such that the utility device is securely disposed within an inner space of the c-shape.

The first and/or second protrusion receivers can be configured to facilitate electrical connection from a power supply to the utility device and to enable electrical (e.g., WiFi) communication with the utility device.

Some embodiments include an actuation unit 313 configured to raise and lower the telescopic mast unit, such as a pneumatic pump (FIG. 3).

As described herein, in some embodiments, the mounting member can be a receiver hitch of a vehicle, a tripod, a wall, a vehicle wheel, or other known or later developed mounting members. With any of these mounting members, a support mount for a telescoping mast unit can be provided with quick-change structures to facilitate quick installation/removal/re-location of a telescoping mast unit. The mast elevation system can further accommodate various utility devices based on application needs.

Figure 8:
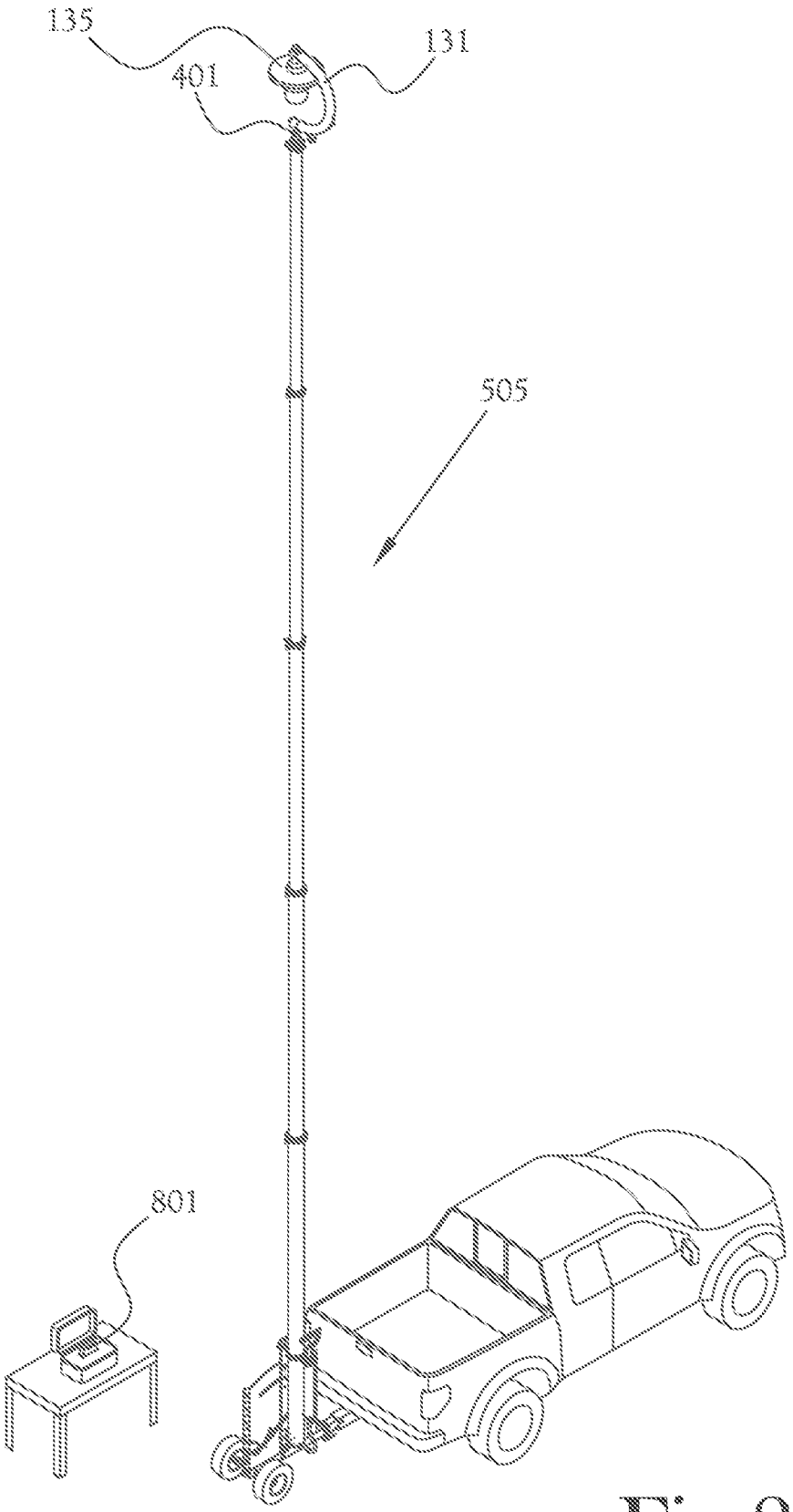
FIG. 8 illustrates a telescoping mast support system attached to a hitch receiver of a vehicle according to an example embodiment of the present general inventive concept, with the mast elevated to a raised position.

In some embodiments, referring to FIG. 8, a control unit 801 can be implemented to control power and operation of the utility devices. A power connection can be provided to communicate 12V power from an accessory plug of a vehicle. The control unit can include a link (e.g., QR code) to an App for purposes of controlling operation, communication, and deployment of the mast elevation system.

The systems, apparatus, methods, processes, functions, App, and/or operations for implementing the example embodiments of the present general inventive concept may be wholly or partially implemented in the form of a set of instructions executed by one or more programmed computer processors such as a central processing unit (CPU) or microprocessor. Such processors may be incorporated in the circuitry and components of an apparatus, hand-held device, server, client or other computing or data processing device operated by, or in communication with, other components of the system.

It is understood that embodiments of the present general inventive concept as described above, such as the control App, can be implemented in the form of control logic using computer software in a modular or integrated manner. Based on the disclosure and teachings provided herein, a person of ordinary skill in the art will know and appreciate other ways and/or methods to implement the present invention using hardware and a combination of hardware and software.

The subject matter of the present general inventive concept is described herein with specificity to meet statutory requirements, but the description herein is not intended to limit the scope of the claims. Those skilled in the art will appreciate that the claimed subject matter may be embodied in a variety of ways using sound engineering judgement and/or knowledge in the field, may include different elements or steps, and may be used in conjunction with other existing or future technologies. This description should therefore not be interpreted as implying any particular order or arrangement among or between various steps or elements except when the order of individual steps or arrangement of elements is explicitly described.

For example, the mast elevation system can comprise one or more of the features, devices, functions, components, or structures described or illustrated herein, including any combination, arrangement, or sub-combination of such features, devices, functions, components, or structures, separately or in any combination with one another, including any equivalents thereof.

It is to be noted that terms such as "example embodiments of the present general inventive concept" or "invention" are intended to refer broadly to all the subject matter described in this document and to the claims. Statements containing these terms should be understood not to limit the subject matter described herein or to limit the meaning or scope of the claims.

It is understood that numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment.

This written description uses examples to disclose certain implementations of the disclosed technology, and also to enable any person skilled in the art to practice certain implementations of the disclosed technology, including making and using any devices or systems and performing any incorporated methods. The patentable scope of certain implementations of the disclosed technology is defined in the claims, and may include other examples that occur to those skilled in the art. Such other examples are intended to be within the scope of the claims if they have structural and/or functional elements that do not differ from the literal language of the claims, or if they include structural and/or functional elements with insubstantial differences from the literal language of the claims.

What is claimed is:

1. A mast elevation system, comprising:

a support mount configured to be removably attachable to a mounting member;

a telescopic mast unit having quick-change attachment means disposed on the outer diameter of the telescopic mast unit proximate a first end of the telescopic mast unit, the quick-change attachment means being configured to removably secure the telescopic mast unit to an associated plate member of the support mount, the telescopic mast unit having a second end with a receptacle thereon to receive a utility device; and an actuation unit configured to raise and lower the telescopic mast unit.

2. The system of claim 1, wherein the mounting member is a receiver hitch of a vehicle, and wherein the support mount includes a mounting structure configured to horizontally mate with an inner space of the receiver hitch, the mounting structure having an angular surface extending from a first end of the mounting structure such that when the mounting structure is being removed from the inner space of the receiver hitch, the mounting structure is configured to slidably move horizontally within the inner space of the receiver hitch until the angular surface reaches a receiving end of the receiver hitch, at which time a vertex portion of the angular surface extending from the first end of the mounting structure remains in contact with a bottom portion of the inner space such that the mounting structure is permitted to pivot downward with respect to horizontal while the vertex portion remains in contact with the bottom portion of the inner surface.

3. The system of claim 1, wherein the quick-change attachment means includes a ring member disposed on an outer diameter of the telescopic mast unit spaced apart from the first end of the telescopic mast unit, the ring member having a first protrusion configured to be mate with a first cut-out portion disposed on an upper end of the plate member.

4. The system of claim 3, wherein the mounting structure includes a holster unit configured to receive a bottom end of the plate member, and wherein the quick-change attachment means includes a second protrusion disposed on the first end of the telescopic mast unit, the second protrusion being configured to mate with a second cut-out portion disposed on an upper surface of the holster unit.

5. The system of claim 1, further comprising a utility device holding member configured to hold the utility device thereon, wherein the receptacle is configured to matingly receive a first protrusion of the utility device holding member to secure the utility device holding member to the second end of the telescopic mast unit.

6. The system of claim 5, wherein the utility device holding member is formed in a c-shape such that a top portion of the utility device holding member includes a second protrusion configured to matingly receive the utility device such that the utility device is securely disposed within an inner space of the c-shape.

7. The system of claim 6, wherein the first and/or second protrusions are configured to provide electrical connection to the utility device.

8. The system of claim 1, wherein the mounting member is a wall.

9. The system of claim 1, wherein the mounting member is a tripod.

10. The system of claim 1, wherein the mounting member is a wheel mount having a base member configured to receive a vehicle tire over a top surface of the base member to secure the base member under the vehicle tire, and wherein the plate member is pivotally attached to an outer end of the wheel mount such that the plate member pivots between a first position horizontal to the base member and second position perpendicular to the base member.

* * * * *